US006508729B1

(12) United States Patent
Coltrane et al.

(10) Patent No.: US 6,508,729 B1
(45) Date of Patent: Jan. 21, 2003

(54) GOAL SHOT TRAINING SYSTEM

(76) Inventors: Warren V. Coltrane, 4523 Oakview Dr., Trinity, NC (US) 27370-8407; Michael D. Sink, 6649 Fairview Church Rd., Trinity, NC (US) 27370

( * ) Notice: Subject to any disclaimer, the term of this patent is extended or adjusted under 35 U.S.C. 154(b) by 0 days.

(21) Appl. No.: 09/822,509

(22) Filed: Mar. 30, 2001

(51) Int. Cl.[7] ..... A63B 69/00
(52) U.S. Cl. ..... 473/446; 273/402; 473/478
(58) Field of Search ..... 473/404, 455, 473/456, 195, 197, 172, 478, 446; 273/398, 401, 402, 400; 297/452.63, 452.64; 405/186; 482/105

(56) References Cited

U.S. PATENT DOCUMENTS 3,312,467 A * 4/1967 Dawson ..... 473/454
3,583,703 A * 6/1971 Brown et al. ..... 473/456
3,808,824 A * 5/1974 Johnston et al. ..... 405/186
4,057,291 A * 11/1977 Dubinsky ..... 160/371
4,068,846 A * 1/1978 Forrest ..... 473/195
4,783,070 A * 11/1988 Bauer et al. ..... 124/23.1
4,948,147 A * 8/1990 Pallanca ..... 273/396
5,348,291 A * 9/1994 Scully ..... 473/454
5,433,434 A * 7/1995 Helmetsie ..... 473/446
5,511,775 A * 4/1996 Parks ..... 273/400

* cited by examiner

*Primary Examiner*—Mark S. Graham
(74) *Attorney, Agent, or Firm*—Kaardal & Leonard, LLP

(57) ABSTRACT

A goal shot training system for dividing the plane of goal into a plurality of zones for targeting shots on the goal. The goal shot training system provides a system for training shots on a goal of the type having a pair of laterally-spaced, substantially vertically oriented upright members and a substantially horizontally oriented cross member extending between the upright members, with the upright members and the cross member defining a goal plane. The system comprises a first strap for suspending from the cross member of the goal for dividing the goal plane into horizontally-separated zones and a second strap for extending between the upright members for dividing the goal plane into vertically-separated zones. In one preferred embodiment of the invention, a pair of the first straps and a pair of the second straps are included.

12 Claims, 3 Drawing Sheets

GOAL SHOT TRAINING SYSTEM

BACKGROUND OF THE INVENTION

1. Field of the Invention

The present invention relates to soccer training devices and more particularly pertains to a new goal shot training system for dividing the plane of goal into a plurality of zones for targeting shots on the goal.

2. Description of the Prior Art

Points are scored in the game of soccer by moving the soccer ball through a rectangular goal comprised of substantially vertical uprights and a cross member extending between the uprights. The uprights and cross member define a goal plane through which the ball must pass to score a point. Thus, soccer players often practice goal shots (either through kicking or impacting the ball with the head) into the goal to improve their ability to move the ball between the uprights during soccer games. However, accuracy in simply moving the ball between the uprights is often not enough to score a goal as a goalie is typically positioned in front of the goal plane for attempting to block a ball moving toward the goal plane from moving through the goal plane. Thus, it often not sufficient just to hit the ball in the direction of the goal in order to score a point. The player needs to be able to aim the path of the ball with the position and movement of the goalie in mind in order to avoid the goalie. Thus, players must train to improve their skills at aiming the movement of the soccer ball toward various areas of the goal plane to effectively avoid the goalie. Thus, a player's ability to aim and move the ball through different areas of the goal plane is important.

The goal shot training system according to the present invention substantially departs from the conventional concepts and designs of the prior art, and in so doing provides an apparatus primarily developed for the purpose of dividing the plane of goal into a plurality of zones for targeting shots on the goal.

SUMMARY OF THE INVENTION

In view of the foregoing disadvantages inherent in the known types of soccer training devices now present in the prior art, the present invention provides a new goal shot training system construction wherein the same can be utilized for dividing the plane of goal into a plurality of zones for targeting shots on the goal.

To attain this, the present invention provides a system for training shots on a goal of the type having a pair of laterally-spaced, substantially vertically oriented upright members and a substantially horizontally oriented cross member extending between the upright members, with the upright members and the cross member defining a goal plane. The system comprises a first strap for suspending from the cross member of the goal for dividing the goal plane into horizontally-separated zones and a second strap for extending between the upright members for dividing the goal plane into vertically-separated zones. In one preferred embodiment of the invention, a pair of the first straps and a pair of the second straps are included. Optionally, the first strap has a pair of ends removably connectable together to form a loop. As a further option, the first strap has a pair of ends, and a portion of the first strap located adjacent to one of the ends of the first strap being weighted relatively heavier than a remainder portion of the first strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
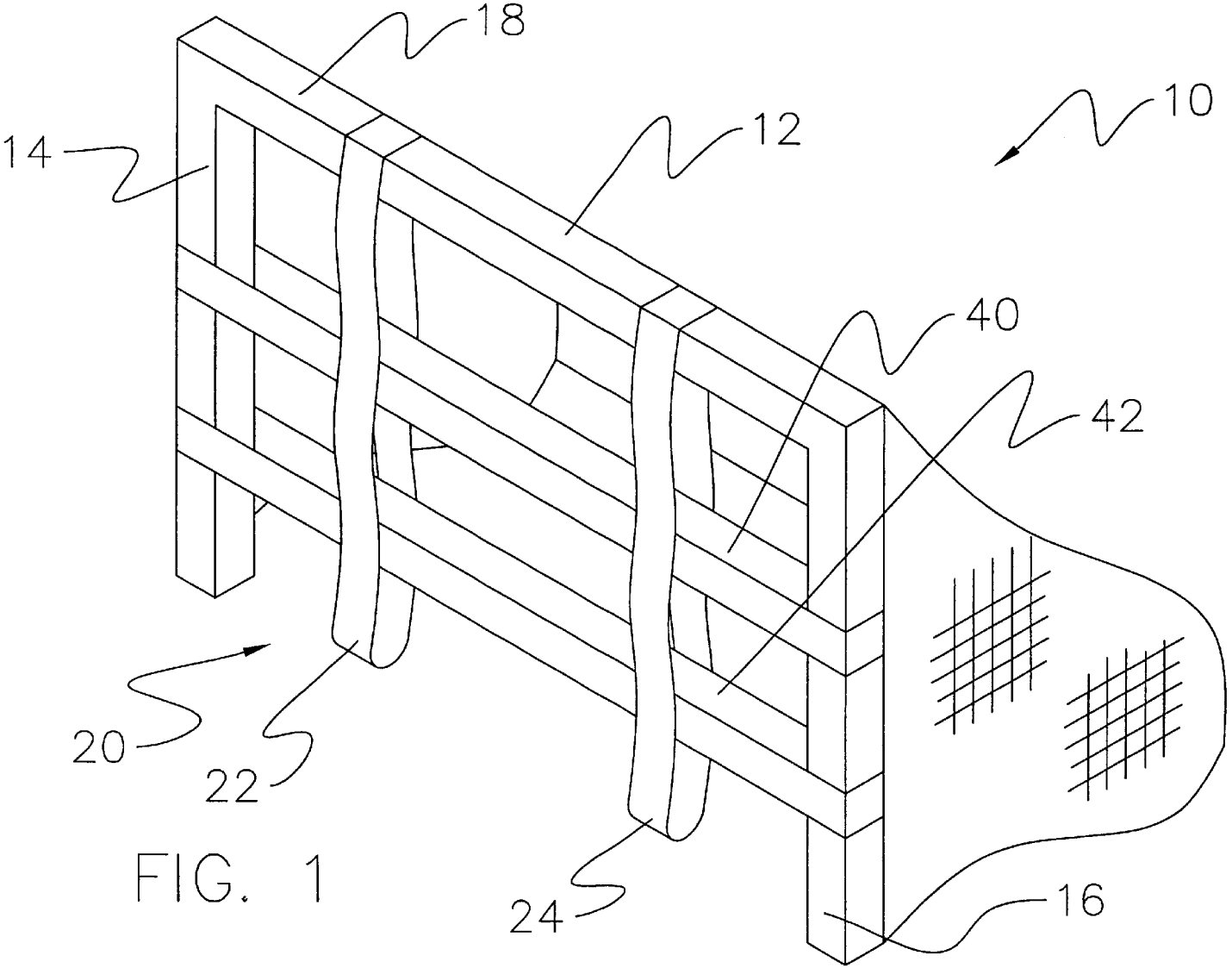
FIG. 1 is a schematic perspective view of a new goal shot training system according to the present invention shown mounted on a goal.
Figure 2:
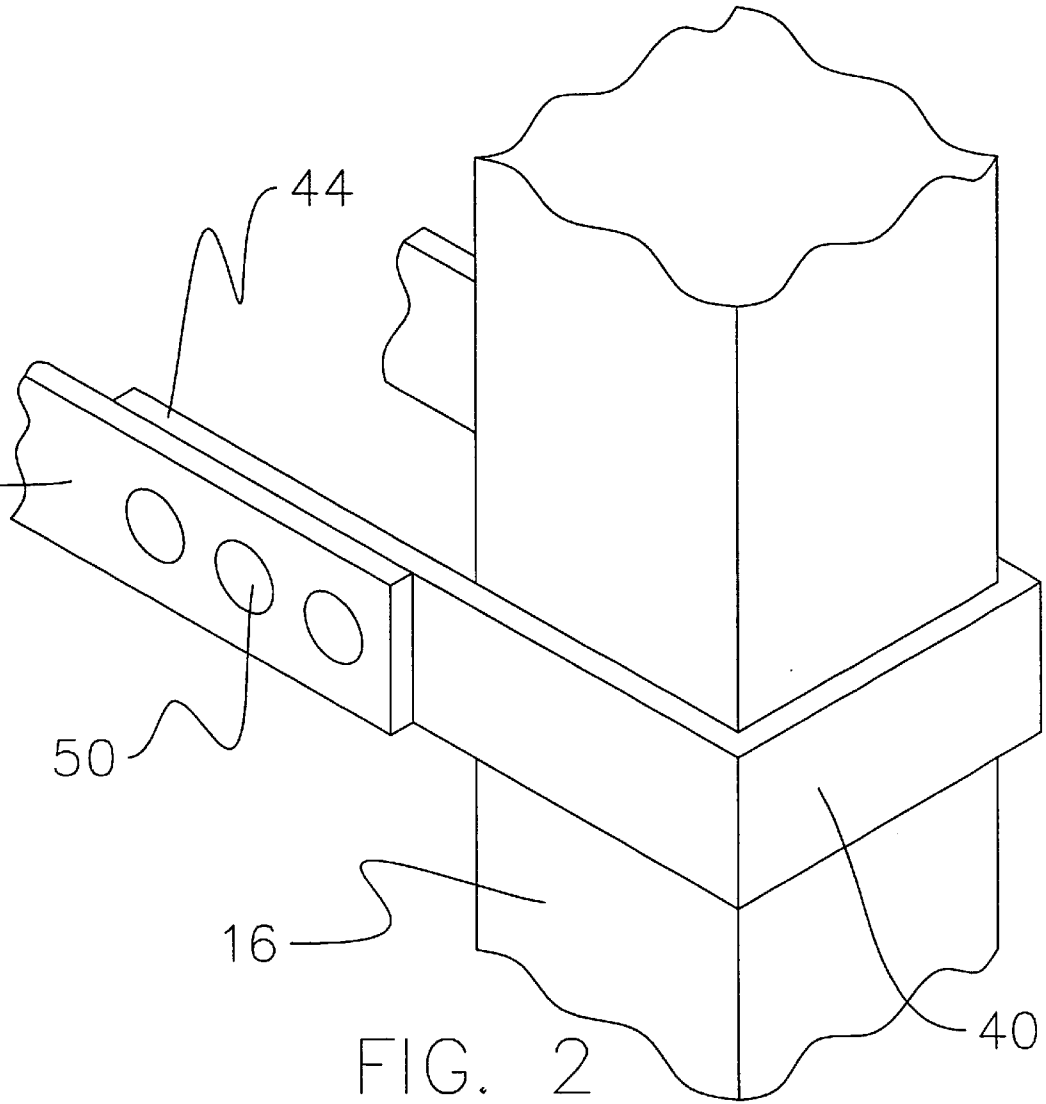
FIG. 2 is a schematic perspective view of a portion of one of the second straps and a portion of the goal.
Figure 4:
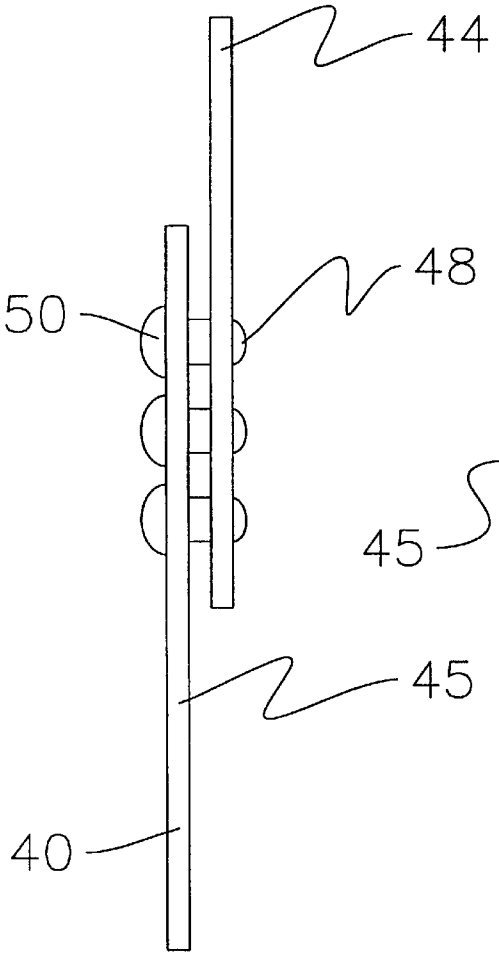
FIG. 4 is a schematic side view of the connected ends of one of the straps of the present invention.
Figure 3:
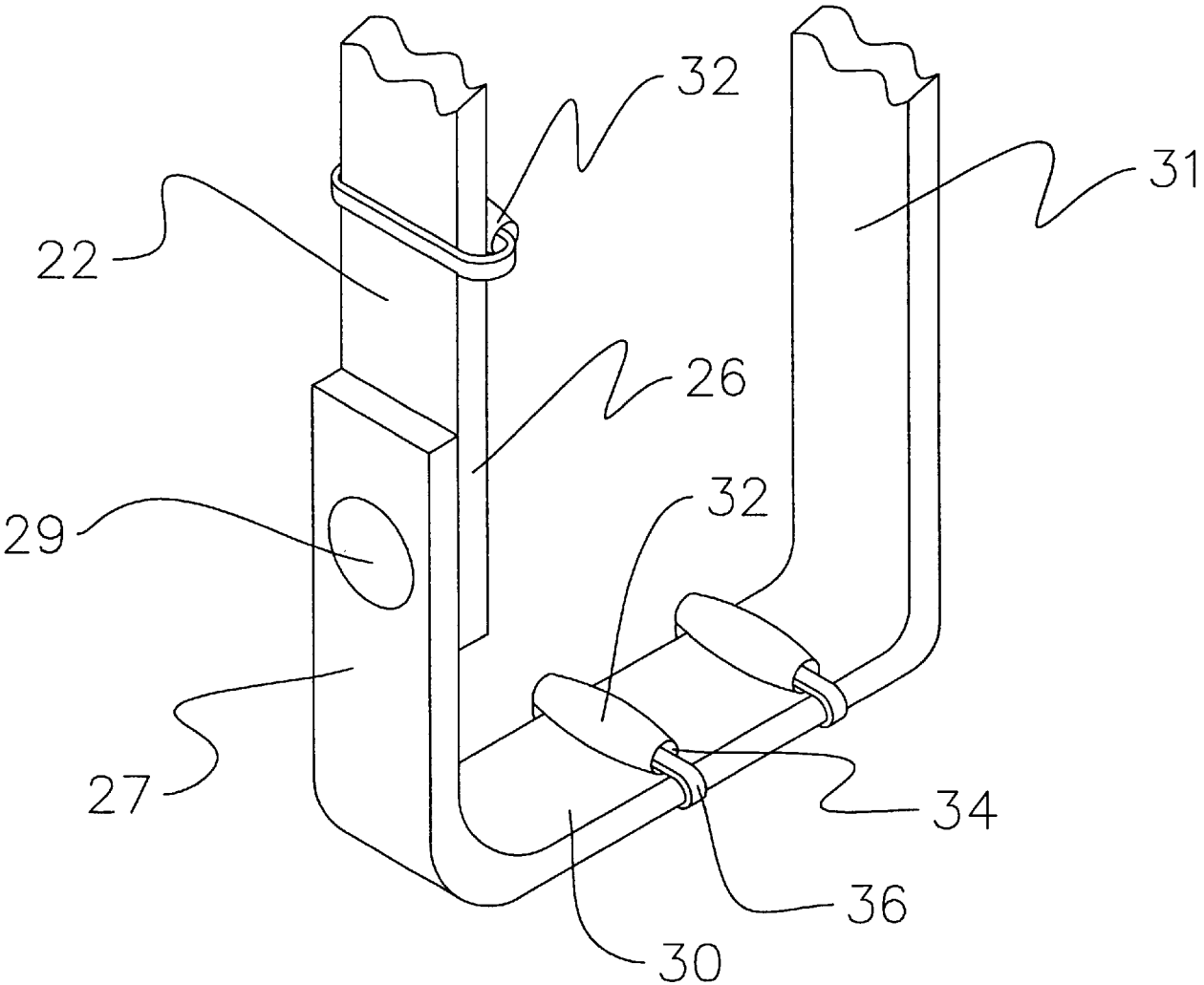
FIG. 3 is a schematic perspective view of a portion of one of first straps of the present invention.

With reference now to the drawings, and in particular to FIGS. 1 through 4 thereof, a new goal shot training system embodying the principles and concepts of the present invention and generally designated by the reference numeral 10 will be described.

The system 10 of the invention for training shots on a goal may include a goal 12 having a pair of laterally-spaced, substantially vertically oriented upright members 14, 16, and a substantially horizontally oriented cross member 18 extending between the upright members. The upright members 14, 16 and the cross member 18 define a goal plane.

The system 10 includes a goal plane partitioning assembly 20 for dividing the goal plane into a plurality of zones. The goal plane partitioning assembly 20 includes at least one first strap 22 for suspending from the cross member of the goal and thereby dividing the goal plane into horizontally separated zones. In one highly preferred embodiment of the invention, a pair of first straps 22, 24 is included for suspending from the cross member 18 to divide the goal plane into three horizontally-separated zones.

The first straps 22, 24 may have a pair of ends 26, 27 removably connectable together to form a loop. A first one 26 of the ends of the first strap may have a connector structure (not shown) complementary to a connector structure 29 on a second one 27 of the ends. The loop formed by the first strap may thus be looped about the cross member 18.

A portion 30 of each of the first straps 22, 24 located adjacent to at least one of the ends 26, 27 of the first strap is weighted relatively heavier than a remainder portion 31 of the first strap. Optionally, each of the end portions of the first strap is weighted relatively heavier than the remainder portion between the end portions. In one embodiment of the invention, at least one weight 32 is mounted on each of the first straps 22, 24 adjacent to each end of the strap. The weight 32 may have a channel 34 therethrough, and a cord 36 may extend through the channel and loop about the first strap. Illustratively, the weight may comprise lead. Preferably, the first straps 22, 24 are formed of a resiliently elastic band.

The goal plane partitioning assembly includes at least one second strap 40 for extending between the upright members 14, 16 to divide the goal plane into vertically separated zones. In one highly preferred embodiment of the invention, a pair of second straps 40, 42 are included for extending between the upright members to divide the goal plane into three vertically separated zones. The second straps 40, 42 each may have a pair of ends 44, 45 that are removably connectable together to form a loop that encircles the uprights. Preferably, a first one 44 of the ends of the second strap has a connector structure 48 that is complementary to a connector structure 50 on a second one 47 of the ends. Preferably, the second straps 40, 42 are formed of a resiliently elastic band to permit the straps to be stretched between the uprights to create tension in the straps that serve to hold the straps in position on the uprights. Optionally, the length of the second straps may be sized so that the straps must be stretched to form a loop about the spaced uprights to that a tension is created.

In use, the first straps 22, 24 are looped about and suspended from the cross member, with the weighted portions located relatively close to the ground under the goal plane so that a measure of tension is created in the first straps that tend to hold the straps in a substantially vertical orientation. The first straps may be slid or otherwise moved along the cross member to increase or decrease the horizontal spacings of the straps and the relative horizontal size of the zones. The second straps 40, 42 are looped about the uprights and may be moved vertically to increase or decrease the vertical spacings to thereby adjust the relative vertical size of the zones. Using the invention, the goal plane may be divided into nine zones of adjustable size, so that not only a center of the goal plane may be targeted, but also side areas of the goal plane may be targeted for practicing shots that may be used to avoid, for example, a goalie positioned in front of the goal. However, the invention permits shot practice without the presence of a goalie.

The player may practice shots through particular zones of the goal plane, and the player is provided with the ability to see what zone of the goal plane the ball actually moved through if the ball misses the intended zone, Optionally, only one of each of the first and second straps may be us ed, for example, to create relatively larger zones for less practiced or less experienced players that may have difficulty hitting relatively smaller zones. Further, shot accuracy games may be employed using the invention, such as by awarding various amounts of points for more accurate and less accurate goal shots.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A system for training shots on a goal, the system comprising:

a goal having a pair of laterally-spaced, substantially vertically oriented upright members and a substantially horizontally oriented cross member extending between the upright members, the upright members and the cross member defining a goal plane;

a first strap suspended from the cross member of the goal for dividing the goal plane into horizontally-separated zones; and a second strap extending between the upright members for dividing the goal plane into vertically separated zones;

wherein at least one weight is mounted on the first strap, the at least one weight having a channel therethrough, a cord extending through the channel and being looped about the first strap.

2. The system of claim 1 wherein the first strap has a pair of ends removably connectable together to form a loop.

3. The system of claim 2 wherein a first one of the ends of the first strap has a connector structure complementary to a connector structure on a second one of the ends.

4. The system of claim 3 wherein each of the connector structures comprises a snap component.

5. The system of claim 1 wherein the first strap has a pair of ends, and wherein a portion of the first strap located adjacent to each of the ends of the first strap being weighted relatively heavier than a remainder portion of the first strap between the end portions.

6. The system of claim 1 wherein at least one of the straps is formed of a resiliently elastic band.

7. The system of claim 1 wherein a pair of the first straps are suspended in a spaced relationship with respect to each other to divide the goal plane into three horizontally-separated zones.

8. The system of claim 1 wherein the second strap has a pair of ends removably connectable together to form a loop, a first one of the ends of the second strap having a connector structure complementary to a connector structure on a second one of the ends.

9. The system of claim 1 wherein each of the connector structures comprises a snap component.

10. The system of claim 1 wherein a pair of the second straps extend in a spaced relationship with respect to each other to divide the goal plane into three vertically-separated zones.

11. A system for training shots on a goal comprising:

a goal having a pair of laterally spaced, substantially vertically oriented upright members, a substantially horizontally oriented cross member extending between the upright members, the upright members and the cross member defining a goal plane;

a goal plane partitioning assembly for dividing the goal plane into a plurality of zones, the assembly comprising:

a pair of first straps suspended from the cross member of the goal and dividing the goal plane into horizontally separated zones;

wherein the first straps have a pair of ends removably connectable together to form a loop, a first one of the ends of the first straps having a connector structure complementary to a connector structure on a second one of the ends;

wherein a portion of each of the first straps located adjacent to each of the ends of the first strap being weighted relatively heavier than a remainder portion of the first strap between the end portions, wherein at least one weight is mounted on each of the first straps, the at least one weight having a channel therethrough, a cord extending through the channel and being looped about the first strap, the at least one weight comprising a lead weight; and wherein the first straps are formed of a resiliently elastic band;

a pair of second straps extending between the upright members and dividing the goal plane into three vertically separated zones;

wherein the second strap has a pair of ends removably connectable together to form a loop, a first one of the ends of a second strap having a connector structure complementary to a connector structure on a second one of the ends; and wherein a second strap is formed of a resiliently elastic band.

12. A system for training shots on a goal, comprising:

a goal having a pair of laterally-spaced, substantially vertically oriented upright members and a substantially horizontally oriented cross member extending between the upright members, the upright members and the cross member defining a goal plane;

a goal plane partitioning assembly for dividing the goal plane into a plurality of zones, the assembly comprising:

a pair of first straps suspended from the cross member of the goal and dividing the goal plane into horizontally separated zones; and a pair of second straps extending between the upright members and dividing the goal plane into three vertically separated zones;

at least one weight mounted on each of the first straps for weighting a portion of the first strap greater than a reminder of the first strap, the at least one weight being mounted on a cord extending in a loop about the first strap.

* * * * *